United States Patent [19]

Queneau et al.

[11] 3,991,159

[45] Nov. 9, 1976

[54] HIGH TEMPERATURE NEUTRALIZATION OF LATERITE LEACH SLURRY

[75] Inventors: Paul B. Queneau, Golden; Eddie C. Chou, Arvada, both of Colo.

[73] Assignee: Amax Inc., New York, N.Y.

[22] Filed: Jan. 9, 1975

[21] Appl. No.: 539,616

[52] U.S. Cl. ..... 423/150; 423/141

[51] Int. Cl.[2] ..... C01G 51/10; C01G 53/10

[58] Field of Search ..... 423/150, 140, 141, 123; 75/119

[56] References Cited

UNITED STATES PATENTS

| | | | |
|---|---|---|---|
| 3,720,749 | 3/1973 | Taylor et al. | 75/119 |
| 3,761,566 | 9/1970 | Michal | 423/150 |
| 3,804,613 | 4/1974 | Zundel et al. | 75/119 |

FOREIGN PATENTS OR APPLICATIONS

| | | | |
|---|---|---|---|
| 618,826 | 4/1961 | Canada | 423/150 |

*Primary Examiner*—Oscar R. Vertiz
*Assistant Examiner*—Brian E. Hearn
*Attorney, Agent, or Firm*—Kasper T. Serijan; Eugene J. Kalil

[57] ABSTRACT

The pregnant solution obtained from high pressure and high temperature leaching of nickel-cobalt bearing low magnesium oxidic ores is neutralized at high temperature and pressure by coordinating the leaching of the low magnesium ores with the leaching of nickel-cobalt bearing high magnesium ores, the leach slurry from said low magnesium ore being neutralized by mixing it with said high magnesium ore which is simultaneously leached with said solution to produce a final pregnant solution from which metal values are subsequently recovered.

8 Claims, 5 Drawing Figures

HIGH TEMPERATURE NEUTRALIZATION OF LATERITE LEACH SLURRY

This invention relates to the recovery of nickel and cobalt from nickeliferous oxidic ores and, in particular, to a method of coordinating the leaching of low magnesium-containing nickeliferous ores with the leaching of high magnesium containing nickeliferous ores to recover nickel and cobalt values therefrom while improving the efficiency thereof in terms of acid consumption.

STATE OF THE PRIOR ART

Methods are known to recover nickel and cobalt from lateritic and serpentine ores. One method, which is referred to as the Moa Bay process, comprises pulping the nickel ore (95% passing 325 mesh) to approximately 40% solids, and then selectively leaching the nickel and cobalt with sulfuric acid at elevated temperature and pressure (e.g. 475° F [245° C] and 525 psig) to solubilize about 95% each of the nickel and cobalt. The leached pulp is cooled and then washed by countercurrent decantation, with the washed pulp going to tailings. The acid pH which is quite low is then neutralized with coral mud to a pH of about 2.5 to 2.8 and the thus-treated product liquor (containing generally about 4 to 6 grams of nickel per liter) is then subjected to sulfide precipitation by preheating the leach liquor and carrying out the precipitation with $H_2S$ in an autoclave at about 250° F (121° C) and a pressure of about 150 psig. Usually, nickel sulfide seed is added at the feed end to assure substantially complete precipitation of the nickel and cobalt.

After the sulfide precipitate has been washed and thickened to about 65% solids, it is oxidized in an autoclave at about 350° F (177° C) and a pressure of about 700 psig. The solution of solubilized nickel and cobalt is neutralized with ammonia to a pH (5.35) sufficient to precipitate any iron, aluminum and chromium present using air as an oxidant, the precipitate being thereafter separated from the solution. The nickel and cobalt solution is thereafter adjusted in pH to about 1.5 and $H_2S$ added to selectively precipitate any copper, lead and zinc present, which precipitate is separated from the solution by filtration. The nickel is then selectively recovered from the solution by various methods, one particular method comprising treating the solution in an autoclave with hydrogen at a pressure of about 650 psig at a temperature of about 375° F (245° C), using nickel powder as seed material.

Pregnant liquor generated in the aforementioned Moa Bay-type leaching of nickel laterite may contain about 30 gpl (grams per liter) of free sulfuric acid, 2 gpl of aluminum and 1 gpl iron. A typical Moa Bay-type leach is one in which the ore is leached at 240°–260° C at an acid ($H_2SO_4$) to ore ratio between 0.22 and 0.26 and a pulp density of 33%. Many of the refining processes available for the recovery of nickel from the foregoing solution operate most effectively at lower concentrations of acids, iron and aluminum. A typical Moa Bay ore is one containing 1.35% nickel, 0.14% Co, 0.9% Mn, 0.02% Cu, 0.04% Zn, 47% Fe, 10% $Al_2O_3$, 1% MgO and 39.5% of other constituents and water of hydration.

The amount of acid employed to leach the nickel ore is generally in substantial excess of the stoichiometric amount necessary because of the presence of substantial amounts of acid-consuming constituents in the ore, such as magnesium, aluminum, iron and the like. Generally, the pH of the pregnant liquor is quite low (typically 0.5 to 0.7) and, in order to adjust it for the sulfide precipitation of the nickel and cobalt values, an alkaline agent is added, e.g. coral mud, a strong base and the like, which imposes economic disadvantages on the process. The use of a strong base as a neutralizer tends to cause co-precipitation of nickel which should be avoided. For example, in an attempt to use high temperature neutralization of the leach liquor (at 250°C) wherein the liquor was neutralized with MgO to a pH of 1.6, about 35% of the nickel was co-precipitated. However, co-precipitation of nickel is counterproductive and, therefore, prevents the obtaining of the full economic advantages of the process.

In Canadian Pat. No. 618,826 (dated Apr. 28, 1961), a method is proposed for adjusting the pH of a pregnant liquor following primary leaching of a particular ore by employing additional amounts of said ore in the form of a slurry to neutralize excess acid remaining in the pregnant solution. This treatment is carried out at under atmospheric pressure. The patent states that, if ore is employed to neutralize excess acid, it is preferred to add subsequently some lime, limestone or other alkaline agent to adjust the pH of the product or pregnant liquor to the level required (e.g. 3.5 to 4.5) for satisfactory precipitation of aluminum and iron contamination.

It would be desirable to provide a process of leaching low magnesium nickel-cobalt bearing ore wherein a high magnesium nickel-cobalt ore is employed in the neutralization of the leach liquor of the low magnesium ore in such a manner that the excess acid is neutralized and dissolved iron and aluminium rejected from the leach solution, while simultaneously recovering substantial amounts of nickel and cobalt from the high magnesium ore without requiring the subsequent use of an alkaline agent as an additional neutralizer.

We have now found that this can be accomplished by coordinating the leaching of low magnesium nickel-cobalt ore with the leaching of high magnesium nickel-cobalt ore using the same acid throughput.

OBJECT OF THE INVENTION

It is thus the object of the invention to provide a hydrometallurgical method for recovering nickel and cobalt from oxidic ores containing low and high magnesium by coordinating the leaching of low magnesium ore with the leaching of high magnesium ore by using the same acid throughput.

This and other objects will more clearly appear when taken in conjunction with the following claims and the appended drawings, wherein:

STATEMENT OF THE INVENTION

Figure 1:
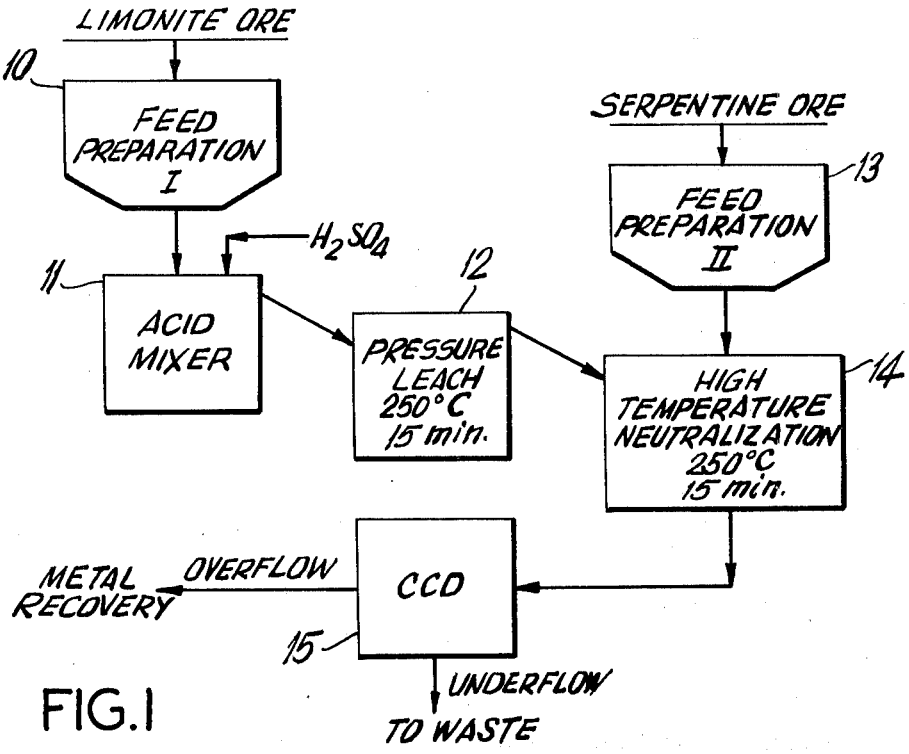
FIGS. 1 and 2 are flow sheets illustrative of several embodiments of the invention.

One embodiment of the invention resides in a method of coordinating the leach of a nickel-cobalt bearing low magnesium oxidic ore with the leaching of a nickel-cobalt bearing high magnesium oxidic ore (neutralizer) which comprises, providing a feed of said low magnesium ore (e.g. limonitic ore) containing by weight up to 3% magnesium and forming an aqueous pulp thereof acidified with an amount of sulfuric acid corresponding to about 0.1 to 0.4 pound of acid per pound of ore taken on the dry basis, pressure leaching the acidified pulp at an elevated temperature of about 225° C to 300° C thereby dissolving substantially said nickel and cobalt and forming a first leached pulp and pregnant solution, providing as a neutralizer a feed of said high magnesium ore containing at least about 5% magnesium (e.g. serpentinic ore), mixing said first leached pulp and pregnant solution with said high magnesium ore feed, subjecting the mixture to high temperature neutralization (acid kill) and leaching at an elevated temperature of about 225° C to 300° C, whereby the pregnant solution of said first leached pulp is neutralized and said high magnesium ore feed is simultaneously leached to form a final pregnant solution from the mixed ores, and then recovering dissolved metal values from the final pregnant solution.

Another embodiment of the invention comprises, providing a feed of the foregoing low magnesium ore containing by weight up to about 3% magnesium and forming an aqueous pulp thereof acidified with an amount of sulfuric acid corresponding to about 0.1 to 0.4 pound of acid per pound of ore on the dry basis, conducting a first leaching step comprising leaching said acidified pulp at an elevated temperature of about 225° C to 300° C, thereby dissolving substantially the nickel and cobalt in the ore and forming a first leached pulp containing the pregnant solution, and subjecting the first leached pulp and pregnant solution to the high temperature neutralization [acid kill process] (at about 225° C to 300° C) by mixing therewith a previously treated thickened pulp obtained from the aforementioned high magnesium ore containing at least about 5% magnesium, thereby forming an augmented pregnant solution which is separated from said pulp mixture, said pulp mixture being thereafter disposed to waste. The next step comprises preparing a feed of said high magnesium ore, mixing said augmented pregnant solution from said first leaching step with said high magnesium ore feed and subjecting said solution to low temperature neutralization not exceeding about 150° C, thereby providing said previously treated pulp for recycling to said first leaching step by thickening said low temperature treated pulp and separating from it a final pregnant solution, the thickened pulp being recycled to said first leach step as a neutralizer, and recovering metal values from said final pregnant solution.

The low magnesium ore employed in the invention contains less than about 3% magnesium while the high magnesium ore (neutralizer) contains at least about 5% magnesium and ranges up to about 15% or 25% by weight magnesium. In order to obtain high nickel extraction and the desired pregnant liquor quality with low reagent consumption, the high temperature neutralization-acid kill process is best when the difference in the magnesium content between the limonitic (low magnesium) and serpentinic (high magnesium) fractions of the ore feed is small (e.g., approximately 6%). The high temperature neutralization process is the best as the difference in magnesium content increases.

As illustrative of the first embodiment of the invention, reference is made to the flow sheet of FIG. 1 which shows a low magnesium ore (limonite) sent to feed preparation 10 where it is formed into a slurry or pulp containing about 36% solids, the pulp being then sent to acid mixer 11 where acid is added to the pulp corresponding to about 0.24 lb. of sulfuric acid to one pound of ore. The acidified pulp is fed to the autoclave at 12 and subjected to high pressure leach at 250° C for 15 minutes at 580 psig. In the meantime, a nickel-cobalt containing high magnesium ore (serpentine) is fed to feed preparation 13 where it is formed into a pulp containing about 33% solids. The high magnesium pulp is combined with the leach slurry from 12 at autoclave 14 where the mix is subjected to high temperature neutralization at 250° C for 15 minutes at 580 psig. The neutralized slurry from autoclave 14 is passed to countercurrent decantation (CCD) 15 to produce an underflow (U'FLOW) of residue which is passed to waste and an overflow (O'FLOW) which goes to metal recovery.

Figure 2:
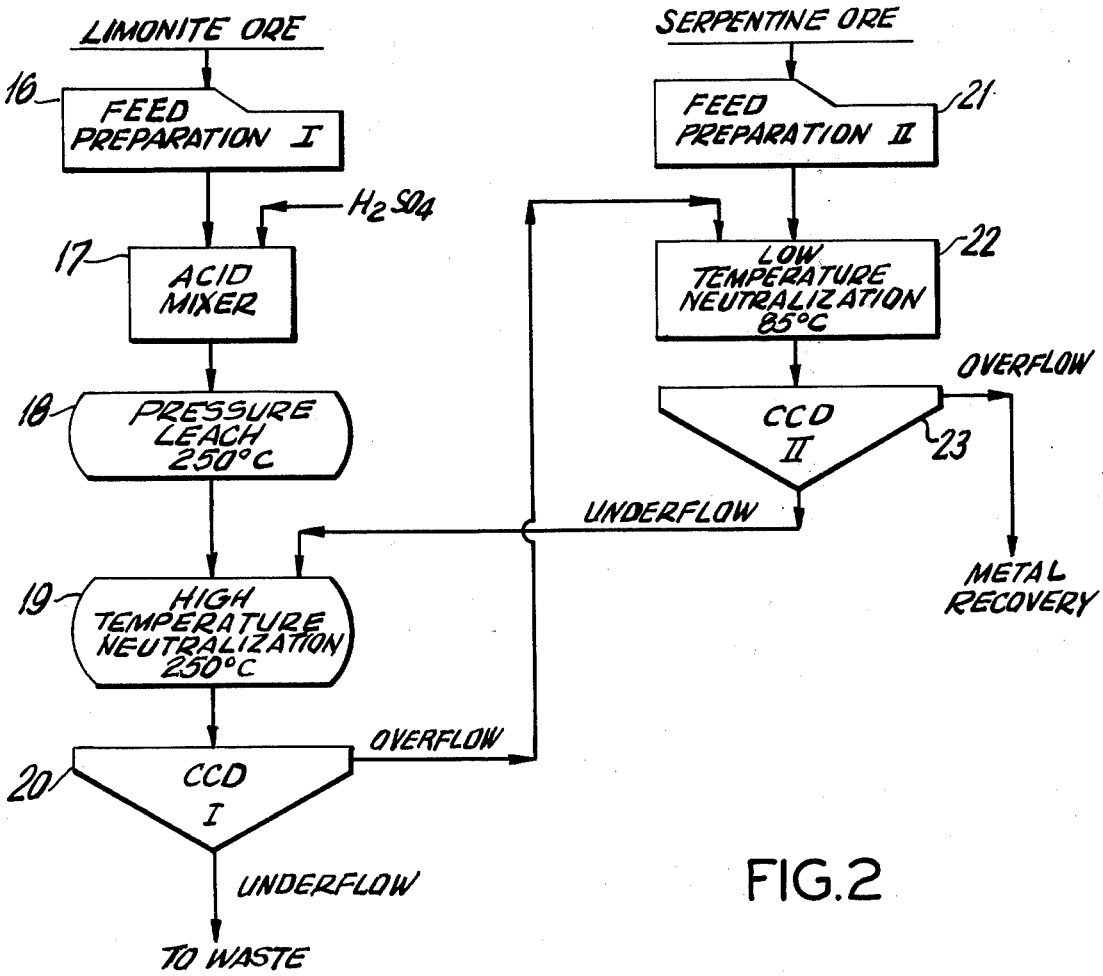

In the embodiment of FIG. 2, limonite ore (low magnesium ore) is sent to feed preparation 16 where it is pulped to a solids density of about 36%, the pulp then being fed to acid mixer 17 where sulfuric acid is added at a weight ratio of about 0.28 part of acid to one part by weight of limonite ore. Following the addition of acid, the acid-pulp mix is charged into an autoclave at 18 where it is subjected to pressure leaching at 250° C for 15 minutes.

In the meantime, high magnesium nickel-cobalt bearing ore (serpentine) is prepared as a pulp in the next column of the flow sheet at 21 and the high magnesium pulp sent to low temperature neutralization, e.g. 85° C, at 22 to which the pregnant solution resulting from the high temperature neutralizer at 19 (250° C) and CCD 20 is fed, the treated high magnesium ore pulp at 22 being thickened at CCD 23, the thickened pulp going to high temperature neutralization at 19. The underflow of both the low and high temperature ores is passed to waste from CCD 20 while the final pregnant solution from CCD 23 is sent to metal recovery.

DETAILS OF THE INVENTION

Tests were conducted with three low magnesium ore fractions shown in Table I below (1L, 2L and 3L) and two types of high magnesium ore 1H and 2H.

Table I

| ORE FEED ASSAYS | | | | | | |
|---|---|---|---|---|---|---|
| | | Limonite Ore | Neutralization Ore | | | |
| | | −20 Mesh 1L | +10 Mesh 2L | 3L | 1H | 2H |
| Feed Assay | Ni | 1.72 | 1.36 | 0.8 | 1.63 | 2.36 |
| | Co | 0.14 | 0.11 | 0.09 | 0.04 | 0.08 |

Table I-continued

| ORE FEED ASSAYS | | | | | | |
|---|---|---|---|---|---|---|
| | | Limonite Ore | Neutralization Ore | | | |
| | | −20 Mesh 1L | +10 Mesh 2L | 3L | 1H | 2H |
| Per- | Fe | 41. | 44. | 38.4 | 12.1 | 13.0 |
| cent | Al | 2.5 | 2.7 | 6.0 | 1.00 | 0.53 |
| | Mg | 1.58 | 1.26 | 0.12 | 13.8 | 15.2 |
| | Mn | 0.80 | 0.64 | 0.46 | 0.21 | 0.21 |
| | Cr | 2.05 | 1.44 | 1.68 | 0.85 | 0.70 |
| | $SiO_2$ | 12.1 | 10.0 | 0.6 | 39.0 | 40.0 |
| | LOI | 11.3 | 11.5 | 12.3 | 10.1 | 11.8 |

The leach and neutralization tests were conducted by drying the ore at 40° C under vacuum, the ore being then leached for 1 hour at 250° C and a pressure of 580 psig and at an acid to ore ratio of 0.24:1, with the pulp at 33% solids. Neutralization was conducted at 250° C by injecting the neutralizer (−200 mesh) at 33% solids all at once into the low magnesium leach slurry. During this period, the temperature dropped between 5° and 25° C during the injection of the neutralizer, 10 minutes being required to heat the slurry back to 250° C. The results are given in Table II below. Ores 2L and 3L were tested as neutralizers along with high magnesium ores 1H and 2H for comparison (Table II), the neutralizers being added to the leach slurry or pulp of ore 1L.

Table II

Neutralization of Ore 1L With Ores 2L, 3L, 1H and 2H for one Hour at 250° C and 0.22 Neutralizer to 1 Part of Ore 1L

| Neutralizer | Residue Assays, % Ni | Al | Ni/Impurity in Solution Ni/Al | Ni/Fe | Ni/Mg | Final Solution pH | Ni Extraction, % Ore 1L | From Neutralizer* | Average |
|---|---|---|---|---|---|---|---|---|---|
| None | 0.08 | 1.90 | 4.0 | 9.2 | 2.0 | 0.5 | 95 | — | — |
| 2L | .22 | 3.00 | 14. | 25. | 2.1 | 0.7 | 95 | 50 | 88 |
| 3L | .20 | 3.00 | 2.1 | 15. | 11. | 0.7 | 95 | 43 | 88 |
| 1H | .36 | 2.60 | 40. | 49. | 0.6 | 1.8 | 95 | 33 | 82 |
| 2H | .36 | 1.95 | 40. | 62. | 0.6 | 1.8 | 95 | 41 | 84 |

*It is assumed all dissloved nickel from Ore 1L remains soluble during the neutralizaton stage.

As will be noted, the high magnesium ores 1H and 2H worked the most effectively as neutralizers as evidenced by the Ni/Al and Ni/Fe ratios in the pregnant solution which ranged from 40 to 1 (Ni/Al) to as high as 62:1 (Ni/Fe), thus indicating that the aluminum and iron are efficiently rejected from solution and the excess acid neutralized from a pH of 0.5 to a pH of 1.8. The leach pulps of ores 1L and 3L on the other hand, were hardly effective as neutralizers (the ores being very low in magnesium). The pH of the solutions after neutralization with ores 2L and 3L was less than 1, i.e. 0.7, and was accompanied by much less rejection of iron and aluminum. As will be noted, the combined average recovery of nickel for both ores 1L and 1H and ores 1L and 2H were 82% and 84%, respectively, accompanied by high rejection of iron and aluminum. Ore 1H is a serpentine and garnierite-type ore while ore 2H is a garnierite-type ore.

The effect of temperature, time, the method of addition and the amount of neutralizer using 2H ore was determined using the filtrate from ore 1L as the media to be neutralized. The results obtained are set forth in Tables III to VII as follows:

Table III

Temperature Effect on the Neutralizaton of Ore 1L Leach Liquor With 120 Grams of 2H Ore per Liter of the Leach Liquor. (Total Neutralization Time From Room Temperature to 250° C Was Two Hours.)

| Neutralization Temperature, ° C | Residue Assays, % Ni | S | Ni/Impurity in Solution Ni/Al | Ni/Fe | Ni/Mg | Solution pH | Ni Extraction, % |
|---|---|---|---|---|---|---|---|
| 150 | 1.92 | 0.3 | 4.3 | 10. | 1.0 | 1.3 | 45 |
| 200 | 1.88 | 0.5 | 7.4 | 69. | .86 | 1.3 | 47 |
| 250 | 1.74 | 0.8 | 55. | 85. | .85 | 1.6 | 50 |

Table IV

Neutralization Time Effect on the Neutralization of 1L Leach Slurry at 250° C and 0.22 2H to 1L Ore Ratio

| Neutralization Time, Minutes | Neutralization Temperature, ° C | Residue Assays, % Ni | Al | S | Ni/Impurity in Solution Ni/Al | Ni/Fe | Ni/Mg | Solution pH | Ni Extraction, % From 1L | From 2H* | Average |
|---|---|---|---|---|---|---|---|---|---|---|---|
| 0 | 250 | 0.08 | 2.0 | 1.82 | 4.0 | 9.2 | 2.0 | 0.6 | 95 | — | — |
| 5 | 250 | 0.40 | 2.1 | 1.82 | 15. | 19. | 0.88 | 1.1 | 95 | 21 | 77 |
| 10 | 250 | 0.38 | 2.1 | 1.78 | 29. | 39. | 0.71 | 1.3 | 95 | 40 | 79 |
| 15 | 250 | 0.38 | 2.2 | 1.82 | 41. | 59. | 0.65 | 1.6 | 95 | 39 | 81 |
| 30 | 250 | 0.38 | 1.95 | 1.74 | 40. | 61. | 0.60 | 1.7 | 95 | 37 | 83 |
| 60 | 250 | 0.40 | 1.85 | 1.67 | 49. | 63. | 0.56 | 1.8 | 95 | 41 | 84 |

*It is assumed all dissolved nickel from Ore 1L remains soluble during the neutralization step.

TABLE V

NEUTRALIZER ADDITION EFFECT ON THE NEUTRALIZATION OF ORE 1L LEACH SLURRY FOR 20 MINUTES at 250° C and 0.19 2H to 1L ORE RATIO

| Method of Neutralizer Addition | Residue Assays, % Ni | Al | S | Ni/Impurity in Solution Ni/Al | Ni/Fe | Ni/Mg | Solution pH | Ni Extraction, % From 1L | From 2H* | Average |
|---|---|---|---|---|---|---|---|---|---|---|
| All at once to one hour leach slurry | 0.30 | 2.0 | 1.6 | 47 | 49 | 0.65 | 2.0 | 95 | 53 | 86 |
| Stage addition to one hour leach slurry | 0.27 | — | 1.6 | 26 | 31 | 0.68 | 1.9 | 95 | 54 | 88 |
| All at once to 5 minutes leach slurry | 0.40 | 2.1 | 1.6 | 41 | 78 | 0.57 | 1.6 | — | — | 81 |

*It is assumed all dissolved nickel from ore 1L remains soluble during the neutralization stage.

TABLE VI

Effect of Amount of Neutralizer on the Neutralizaton of Ore 1L Leach Slurry for 20 minutes at 250° C

| Ratio Ore 2H to Ore 1L | Residue Assays, % Ni | Al | Ni/Impurity in Solution Ni/Al | Ni/Fe | Ni/Mg | Solution pH | Ni Extraction, % From 1L | From 2H* | Average |
|---|---|---|---|---|---|---|---|---|---|
| 0 | .08 | 1.9 | | 9.2 | 2.0 | 0.5 | 95 | — | — |
| 0.11 | .13 | 2.0 | 21 | 20 | .82 | 1.1 | 95 | 80 | 94 |
| 0.17 | .22 | 1.9 | 28 | 14 | .66 | 1.4 | 95 | 61 | 90 |
| 0.19 | .30 | — | 47 | 49 | — | 2.0 | 95 | 53 | 86 |
| 0.22 | .37 | 1.95 | 33 | 65 | .59 | 1.8 | 95 | 39 | 83 |
| 0.33 | .51 | 1.85 | 36 | 60 | .56 | 1.9 | 95 | 34 | 78 |

*It is assumed all dissolved nickel from ore 1L remains soluble during the neutralization stage.

TABLE VII

Effect of the Total Leaching and Neutralization Time on the Neutralization of Ore 1L Leach Slurry at 250° C and 0.10 2H to 1L Ore Ratio

| Test No. | Leaching Time, Minutes | Neutralization Time, Minutes | Ni Assays in Residue, % | Ni/Impurities in Solution Ni/Al | Ni/Fe | Ni/Mg | Solution pH | Overall Ni Extraction, % |
|---|---|---|---|---|---|---|---|---|
| 1 | 10 | 5* | 0.28 | 18 | 31 | 1.1 | 0.8 | 86 |
| 2 | 10 | 10* | 0.25 | 20 | 29 | 0.9 | 0.9 | 88 |
| 3 | 10 | 15* | 0.22 | 19 | 28 | 0.9 | 0.9 | 90 |
| 4 | 15 | 15 | 0.13 | 12.9 | 8.4 | 1.1 | 0.9 | 94 |
| 5 | 60 | 15 | 0.13 | 21 | 20 | .82 | 1.1 | 94 |
| 6** | 60 | 0 | 0.08 | 4 | 9.2 | 2.0 | 0.5 | 95 |

**Standard Moa Bay-type leach (250° C, 0.24 acid/ore, and 33 percent solids) for comparison with the preceding high temperature neutralization results.
*The neutralizer pulp was preheated to 230° C.

Referring to Table III, it will be noted that as the temperature of neutralization increases from 150° to 250° C using ore 2H as the neutralizer, the acid rejection tends to increase along with the rejection of aluminum and iron. For example, at 200° C, the Ni/Al ratio by weight in the leach solution was 7.4 to 1, whereas, at 250° C, the ratio increased to 55 to 1, thus confirming the markedly increased rejection of aluminum at the higher temperature. In the case of iron, the ratio of Ni/Fe at 150° C was 10 to 1, whereas, at 200° C and 250° C, the ratios were markedly increased to 69 to 1 and 85 to 1, respectively. At 250° C, the pH increased to 1.6, thus confirming that acid rejection is improved at the higher temperature. It will also be noted from Table III, that the percent extraction of nickel from ore 2H (the neutralizer) increases with increased neutralizing temperature.

Table IV shows that the time of neutralization treatment is important. For example, to assure a fairly good recovery of nickel from neutralizing ore 2H, the neutralization time at 250° C should be at least about 10 minutes. Thus, at 15, 30 and 60 minutes treating time, the combined recovery of nickel from both the low magnesium ore 1L and high magnesium ore 2H is 81%, 83% and 84%, respectively. It will also be noted that rejection of aluminum and iron increases when the time of treatment exceeds of 10 minutes and, preferably, is at least about 15 minutes. Increase in treatment time also increases the amount of acid rejected or neutralized as evidenced by a rise in pH from 0.6 (zero time) to a pH of 1.6 or over at a treatment time of at least about 15 minutes.

Figure 3:
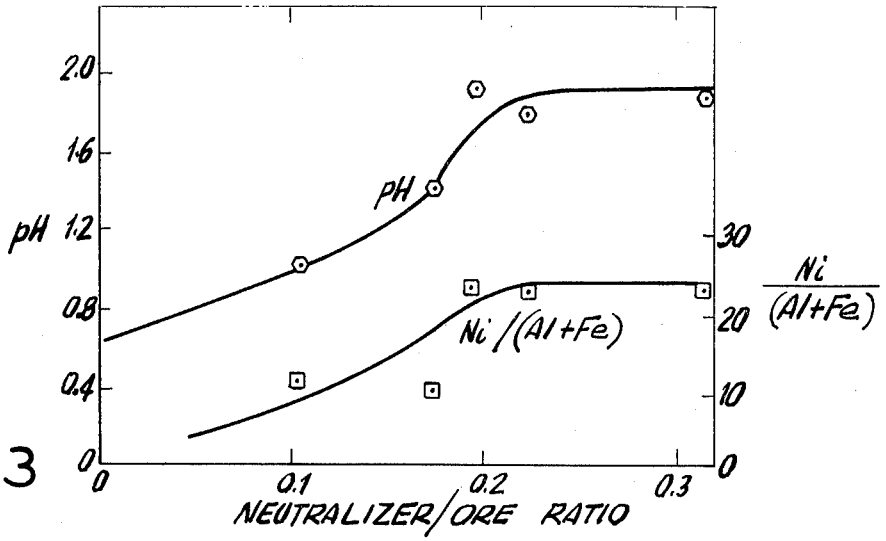
FIG. 3 is a graph showing the variation in pH of the leach liquor as a function of the neutralizer to ore ratio, the graph also depicting the ratio of nickel to impurities (Al + Fe) as a function of said neutralizer to ore ratio.

The variation in pH of the leach slurry with the ratio of neutralizer to ore is shown in FIG. 3, the pH rising substantially to over 1 when the ratio exceeds 0.1 by weight and ranges up to a ratio of 0.5. A preferred ratio is about 0.15 to 0.25 by weight of neutralizer to ore. The figure also shows that the Ni/Al+Fe ratio increases with the neutralizer/ore ratio. The neutralization was performed at 250° C for 20 minutes after 1 hour leaching.

Figure 4:
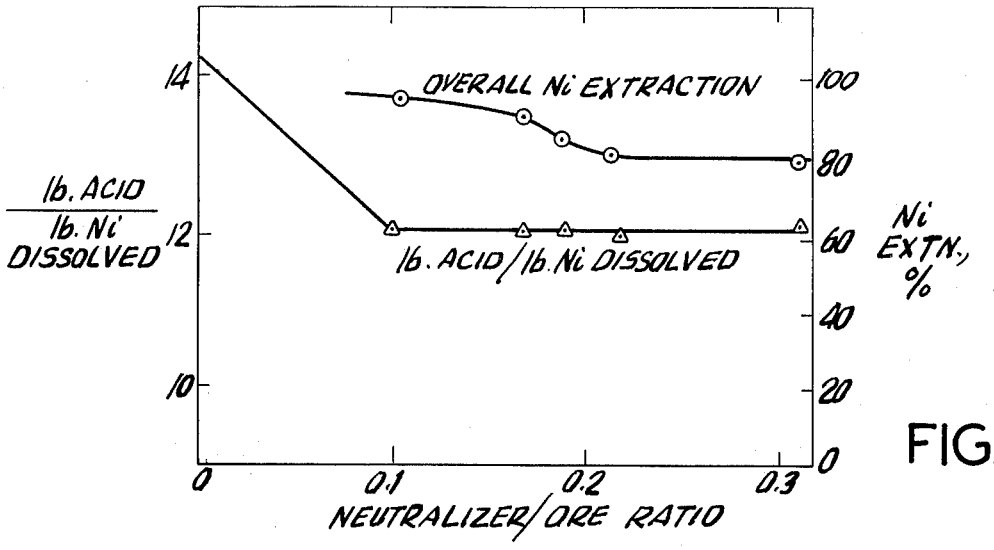
FIG. 4 depicts the acid consumed per pound nickel as a function of the neutralizer to ore ratio, the figure also showing the percent overall nickel extracted as a function of the neutralizer to ore ratio.

FIG. 4 shows acid consumption and nickel extraction as a function of neutralizer/ore ratio under the same condition as the results of FIG. 3. However, it will be noted that, as the amount of neutralizer increases, the overall recovery of nickel decreases.

In achieving optimization of neutralization, the method of addition of the neutralizer may be important as illustrated in Table V. When the neutralizer (2H) is added all at once to a 1 hour leach slurry of ore, 1L, a high rejection of aluminum and iron is obtained (Ni/Al ratio is 47 and the Ni/Fe ratio is 49), the pH rising to about 2. The percent nickel extracted from the neutralizer was 53%, the combined average extraction of nickel from both the leach slurry (ore 1L) and the neutralizer (ore 2H) being about 86%.

Where the neutralizer is added in stages to the leach slurry (Table V), not as much aluminum and iron are rejected; however, the combined average of nickel extracted is about 88%. When the leach slurry has been treated only 5 minutes and the neutralizer added to it all at once, less acid is rejected and the combined average of nickel extraction drops to 81%.

Figure 5:
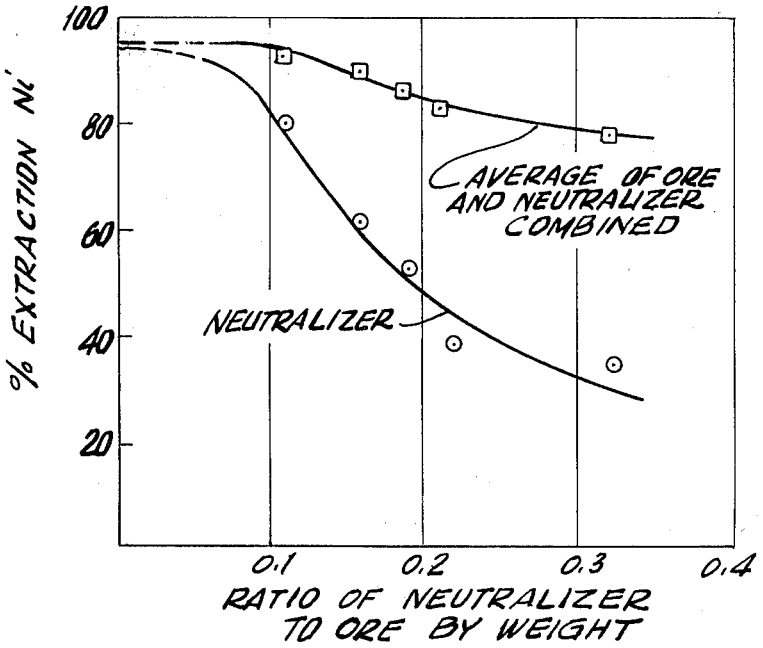
FIG. 5 shows nickel recovery as a function of the neutralizer to ore ratio for the ore-neutralizer mixture and for the neutralizer alone.

Table VI illustrates the effect of neutralizer to ore ratio on the rejection of acid, aluminum and iron and the combined extraction of nickel from both ore 1L and neutralizer ore 2H. The effect of the amount of neutralizer on nickel recovery is shown graphically in FIG. 5. As will be noted, at the ratio of neutralizer to ore increases from 0.11 to 0.33, the amount of nickel extracted from the neutralizer decreases. Referring back to Table VI, it will be noted that the amount of acid, aluminum and iron rejected increases at over a neutralizer/ore ratio of 0.11 and preferably over 0.15. While the neutralizer to ore ratio may range from about 0.1 to 0.5, it is preferred to use a range of about 0.15 to 0.25.

The effect of a neutralizer/ore ratio of about 0.1 as a function of leaching time and neutralization time at 250° C is set forth in Table VII. As will be noted, improved results are achieved at a leaching time of 60 minutes and a neutralization time of 15 minutes with respect to iron and aluminum rejection and with respect to nickel recovery, the total amount of nickel recovered from both ores being about 94%.

As will be apparent from the foregoing, ores not suitable for the Moa Bay-type leaching circuit due to their high magnesium content are particularly useful for neutralizing low magnesium ore. The ores treated in accordance with the invention, including the neutralizer, may have the same composition range of ingredients, except for the soluble magnesium content.

For example, the low magnesium oxidized ore may comprise by weight about 0.5 to 2.5% Ni, about 0.005 to 1% Co, about 0.25 to 5% Mn, about 0.3 to 15% Cr, about 0.2 to 10% Al, less than 3% magnesium, about 2% to 45% $SiO_2$ and about 10% to 55% iron substantially the balance, the foregoing metal values present being in the form of oxides.

The high magnesium ore (neutralizer) may fall within the foregoing composition range, except for the magnesium content which is at least about 5% and which may range to as high as about 25% Mg. Soluble magnesium of the ore is determined by digesting the ore in a sulfuric acid solution of pH 1 maintained for 24 hours at 85° C at said pH.

In summary, the high magnesium ore may effectively neutralize almost all of the free acid in a Moa Bay-type leach slurry, the resulting pregnant solution being relatively high in nickel and generally containing less than about 0.5 gpl of each of aluminum and iron. The addition of the neutralizer in stages to the leach slurry tends to maximize nickel recovery. Aluminum and iron contamination of the product liquor decreases with increased neutralizer; however, nickel recovery also decreases.

Thus, while the ratio of neutralizer to ore may range from about 0.1 to 0.5 to 1 weight or higher, a preferred range is 0.15 to 0.25 in order to obtain the optimum combination of results with respect to rejection of acid, aluminum and iron and the recovery of nickel. However, the ratio will generally depend upon the difference in magnesium content between the low and high magnesium ores, the ratio being smaller the larger the difference.

As will be appreciated, the ratio of the high magnesium ore (neutralizer) to low magnesium ore varies with the relative soluble magnesium level in each of the ores. For example, the greater the difference between the two ores in magnesium content, the less is the amount of the high magnesium ore required as a neutralizing agent. Assuming the low magnesium ore contains 1% soluble Mg and the high magnesium ore contains about 14% soluble Mg, the predetermined ratio of the high magnesium ore added as a neutralizer to the low magnesium ore would preferably be about 1:6 or approximately 0.165 to 1. Where the high magnesium ore contains about 5% soluble Mg, the predetermined ratio would be about 1:2 or 0.5 to 1.

Putting it another way, for a low magnesium ore containing less than 3% Mg and a high magnesium containing over about 5% and ranging to 25% magnesium, the ratio of the high magnesium ore to the low magnesium ore for neutralization will generally vary substantially inversely to the difference in magnesium content of the two types of ore and may range from about a ratio of 0.5 to 1 at the lower range of difference (approximately a difference of 5) to as low as 0.1 to 1 at the higher range of the magnesium difference, for example, a difference of approximately 15.

The greater the difference in the soluble magnesium content between the feed ore (low magnesium ore) and the neutralizing ore (high magnesium ore) the more efficient and economical the process.

In working over the foregoing ranges of magnesium differences, the amount of neutralizer added is predetermined according to its neutralizing effect. Since generally the leach slurry will have a pH of less than about 0.7, the amount of neutralizer should be sufficient to raise the pH to a value not exceeding about 2, preferably 1.2 at 250° C, to effect rejection of the aluminum and the iron in the solution while assuring high recovery of nickel.

In carrying out the high pressure leaching of the ore and also the neutralization thereof, the pressure may range from about 225 psig to 1750 psig at a temperature range of about 200° to 300° C. Preferably, the temperature may range from about 225° to 275° C at a pressure ranging from about 370 psig to 1250 psig. The pulp density of the ore may range from about 25% to 50%.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method of coordinating the leaching of a nickel-cobalt-bearing low magnesium oxidic ore with the leaching of a nickel-cobalt-bearing high magnesium oxidic ore which comprises, providing a feed of said low magnesium ore containing up to about 3% magnesium and forming an aqueous pulp thereof acidified with an amount of sulfuric acid corresponding to about 0.1 to 0.4 pound of acid per pound of ore taken on the dry basis, pressure leaching said acidified pulp at an elevated temperature of about 200° to 300° C and a pressure of about 225 psig to 1750 psig thereby dissolving substantially said nickel and cobalt and forming a first leached pulp and pregnant solution having a pH below about 0.7, providing a feed of said high magnesium ore containing at least about 5% magnesium, mixing said first leached pulp and pregnant solution with a predetermined amount of said high magnesium ore feed sufficient to raise the pH of said solution to a value not exceeding about 2, subjecting said mixture to high temperature neutralization at an elevated temperature of about 200° to 300° C and a pressure of about 225 psig to 1750 psig, whereby the pregnant solution of said first leached pulp is sufficiently neutralized to reject aluminum and iron in said pregnant solution and said high magnesium ore feed is simultaneously leached to form a final pregnant solution, separating the final pregnant solution from the mixed ores, and recovering the dissolved metal values from said final pregnant solution.

2. The method of claim 1, wherein the high magnesium ore contains about 5% to 25% magnesium and wherein the amount of ore employed as a neutralizer varies inversely to the difference in magnesium content between said low magnesium ore and said high magnesium ore.

3. The method of claim 1, wherein the elevated temperature of leaching and neutralization ranges from about 225° to 275° C and the pressure from about 370 psig to 1250 pgig.

4. The method of claim 3, wherein the elevated temperature of leaching and neutralization is approximately 250° C.

5. A method of coordinating the leaching of a nickel-cobalt-bearing low magnesium oxidic ore with the leaching of a nickel-cobalt-bearing high magnesium oxidic ore which comprises, providing a first feed of low magnesium ore containing by weight up to about 3% magnesium and forming an aqueous pulp thereof acidified with an amount of sulfuric acid corresponding to about 0.1 to 0.4 pound of acid per pound of ore on the dry basis, providing a second feed of high magnesium ore containing at least about 5% magnesium, leaching the acidified pulp of said first feed at an elevated temperature of about 200° to 300° C and a pressure of about 225 psig to 1750 psig thereby dissolving substantially said nickel and cobalt and forming a first leached pulp and pregnant solution having a pH below 0.7, subjecting said first leached pulp and pregnant solution to high temperature neutralization at a temperature of about 200° to 300° C and a pressure of about 225 psig to 1750 psig by mixing therewith previously treated thickened pulp of said second feed ore, thereby forming an augmented pregnant solution which is separated from said pulp mixture, the amount of thickened pulp added being sufficient to raise the pH of the pregnant solution to a value not exceeding 2, said pulp mixture being thereafter disposed to waste, mixing said augmented pregnant solution from said first leaching step with the original feed of said high magnesium ore feed and subjecting said solution to low temperature neutralization not exceeding about 150° C, thereby providing said previously treated pulp for recycling to said first leaching step and a final pregnant solution, thickening said low temperature neutralized treated pulp and separating from it said final pregnant solution, recycling said treated thickened pulp of said second feed to said high temperature neutralization step of said first leaching step, whereby to effect rejection of aluminum and iron in said pregnant solution, and recovering metal values from said final pregnant solution.

6. The method of claim 5, wherein the high magnesium ore contains about 5% to 25% magnesium and wherein the amount of ore employed as a neutralizer varies inversely to the difference in magnesium content between said low magnesium ore and said high magnesium ore.

7. The method of claim 5, wherein the elevated temperature of leaching and neutralization ranges from about 225° to 275° C, and the pressure from about 370 psig to 1250 psig.

8. The method of claim 7, wherein the elevated temperature of leaching and neutralization is approximately 250° C.

* * * * *